US007331464B1

(12) United States Patent
MacDonald

(10) Patent No.: US 7,331,464 B1
(45) Date of Patent: Feb. 19, 2008

(54) MEDICAL RECORD KEEPING SYSTEM

(76) Inventor: Marjorie A. MacDonald, 10 Hazeltine Rd., Upton, MA (US) 01568

( * ) Notice: Subject to any disclaimer, the term of this patent is extended or adjusted under 35 U.S.C. 154(b) by 390 days.

(21) Appl. No.: 11/005,358

(22) Filed: Dec. 6, 2004

(51) Int. Cl.
*B65D 69/00* (2006.01)

(52) U.S. Cl. ..... 206/570; 206/232

(58) Field of Classification Search ..... 206/232, 206/308.1, 308.3, 311, 312, 570, 438, 310, 206/223; 281/31, 38; 402/3, 14, 70, 73; 150/115, 109, 119, 902
See application file for complete search history.

(56) References Cited

U.S. PATENT DOCUMENTS

| | | | | | |
|---|---|---|---|---|---|
| 2,595,089 | A | * | 4/1952 | Lifton | 190/108 |
| D250,342 | S | * | 11/1978 | Testro et al. | D19/26 |
| D260,578 | S | | 9/1981 | Cox | |
| 4,415,081 | A | * | 11/1983 | Goncalves | 206/311 |
| 4,417,659 | A | | 11/1983 | Hatchell | |
| 4,598,746 | A | * | 7/1986 | Rabinowitz | 383/25 |
| D300,583 | S | | 4/1989 | Smith | |
| 5,105,949 | A | | 4/1992 | Blair | |
| 5,524,754 | A | * | 6/1996 | Hollingsworth | 206/320 |
| 5,547,226 | A | | 8/1996 | Wentworth | |
| 5,848,700 | A | | 12/1998 | Horn | |
| 5,934,549 | A | | 8/1999 | Baumgartner et al. | |
| D420,385 | S | * | 2/2000 | Inbert | D19/27 |
| 6,202,839 | B1 | * | 3/2001 | Petersen et al. | 206/308.1 |
| 6,250,834 | B1 | * | 6/2001 | Wien | 402/73 |
| 6,289,964 | B1 | * | 9/2001 | Colson et al. | 160/121.1 |
| 7,008,134 | B2 | * | 3/2006 | Lane | 402/73 |

* cited by examiner

*Primary Examiner*—Shian T. Luong

(57) ABSTRACT

A medical record keeping system includes a housing that has a bottom wall and peripheral wall that is attached to and extends upwardly from the housing. A cover is hingedly coupled to an upper edge of the peripheral wall for selectively opening or closing the bottom wall. A panel has a first side, a second side, an upper edge, a lower edge, a first lateral edge and a second lateral edge. A fold line extends from the lower edge to the upper edge and is positioned between the first and second lateral edges. A pair of cavities extends into the first side and extends downward toward the lower edge. Each of a plurality of containers has an open upper end and each s is attached to an inner surface of the peripheral wall so that the upper ends of the container are directed upwardly.

5 Claims, 4 Drawing Sheets

MEDICAL RECORD KEEPING SYSTEM

BACKGROUND OF THE INVENTION

1. Field of the Invention

The present invention relates to record keeping devices and more particularly pertains to a new record keeping device for retaining medical forms and information in convenient and organized manner.

2. Description of the Prior Art

The use of record keeping devices is known in the prior art. U.S. Pat. No. 5,848,700 describes a container adapted for holding a plurality of information packets each having information thereon for treating a particular medical injury. Another type of record keeping device is U.S. Pat. No. 5,105,949 which describes a device for holding both medical records and medication. U.S. Pat. No. 4,417,659 describes a device for organizing medical records and X-ray photographs.

While these devices fulfill their respective, particular objectives and requirements, the need remains for a device that is adapted for organizing and holding an individual's medical information so that it may be readily retrieved as needed. The information may include medical records and past ailments, but also insurance and monetary records. Such a device should also include forms to be filled out by a person to ensure that all relevant information is recorded.

SUMMARY OF THE INVENTION

The present invention meets the needs presented above by generally comprising a housing that has a bottom wall and peripheral wall that is attached to and extends upwardly from the housing. A cover is hingedly coupled to an upper edge of the peripheral wall for selectively opening or closing the bottom wall. A panel has a first side, a second side, an upper edge, a lower edge, a first lateral edge and a second lateral edge. A fold line extends from the lower edge to the upper edge and is positioned between the first and second lateral edges. A pair of cavities extends into the first side and extends downward toward the lower edge. Each of the cavities is positioned between the first lateral edge and the fold line. Each of the cavities has an elongated opening extending along line orientated parallel to the upper edge. The openings of the cavities are vertically spaced from each other. Each of a plurality of containers has an open upper end and each s is attached to an inner surface of the peripheral wall so that the upper ends of the container are directed upwardly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
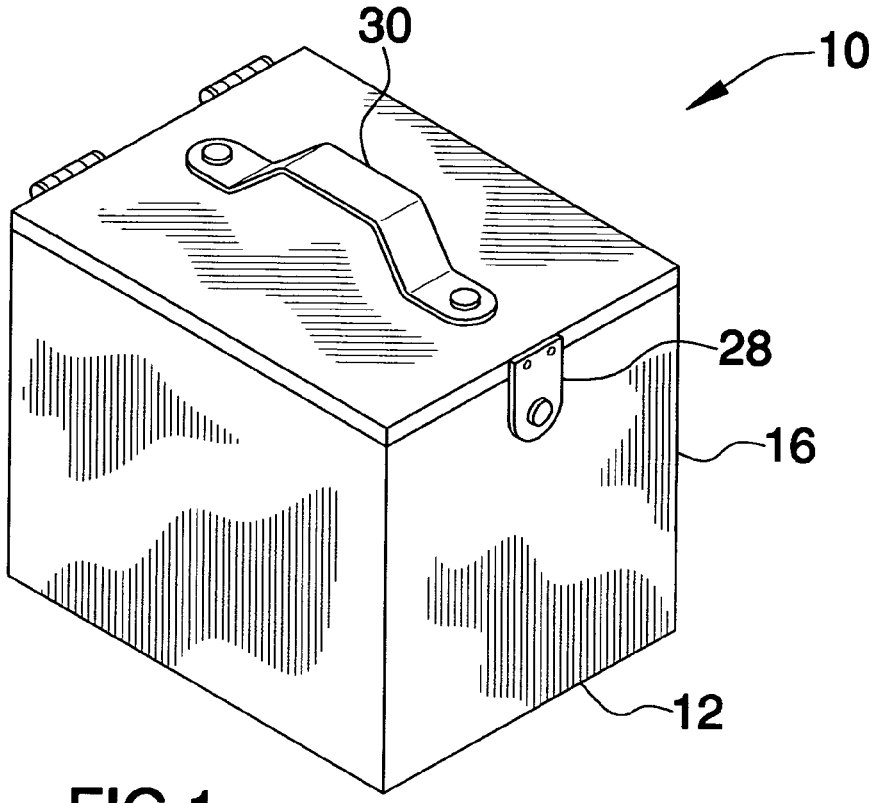
FIG. 1 is a perspective view of a medical record keeping system according to the present invention.
Figure 2:
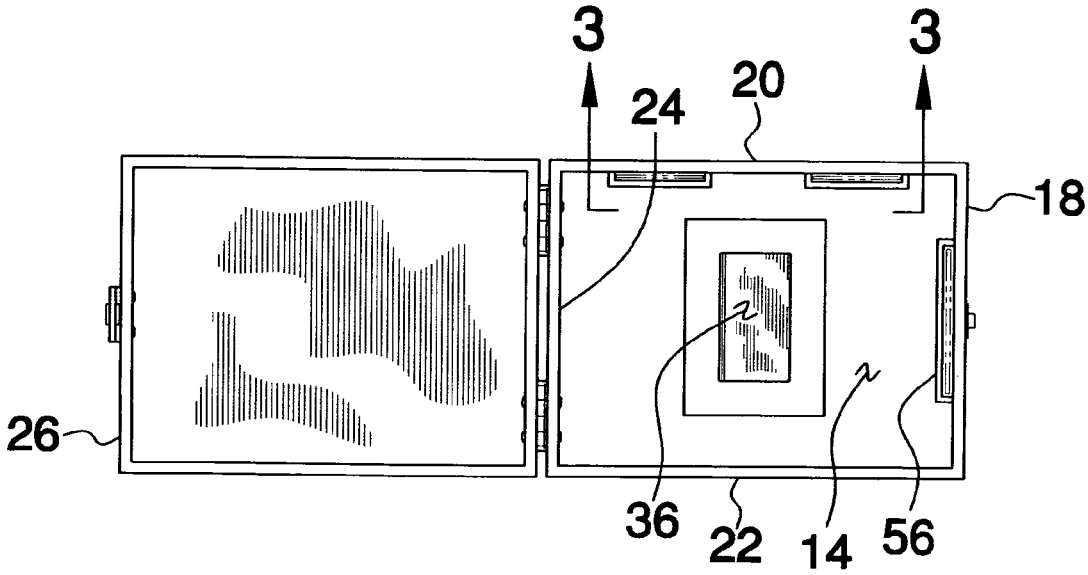
FIG. 2 is a top view of the present invention.
Figure 3:
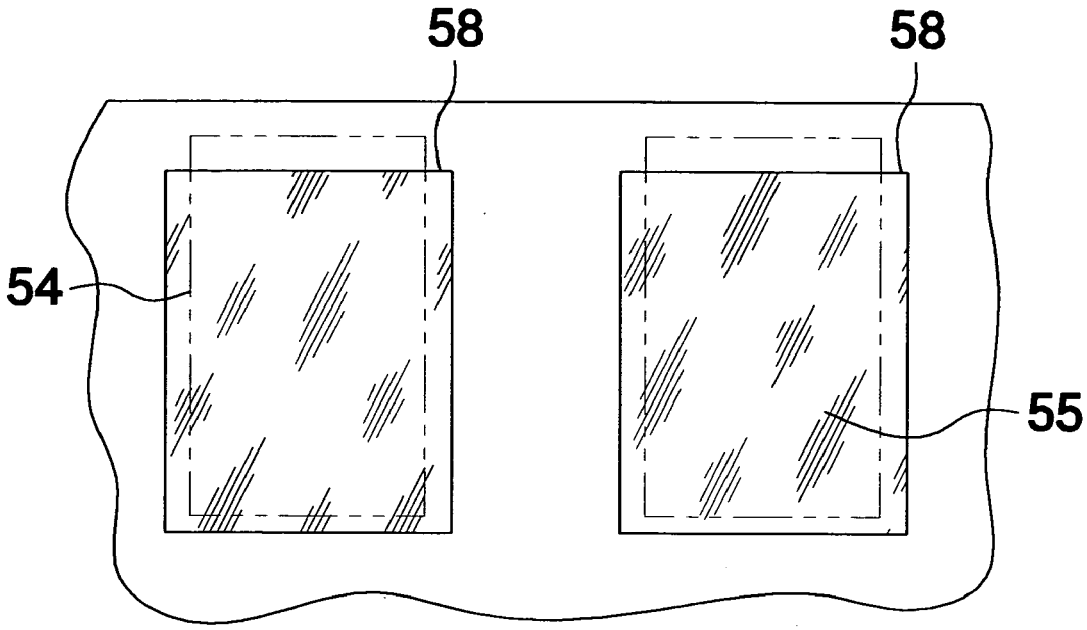
FIG. 3 is a side view taken along line 3-3 of FIG. 2 of the present invention.
Figure 4:
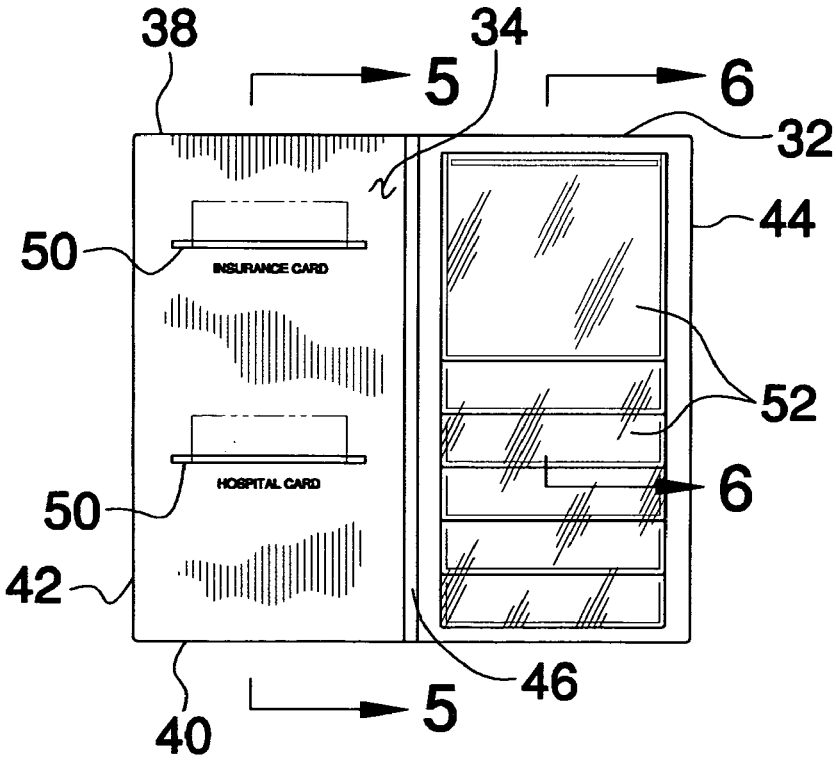
FIG. 4 is a front view of a panel of the present invention.
Figure 5:
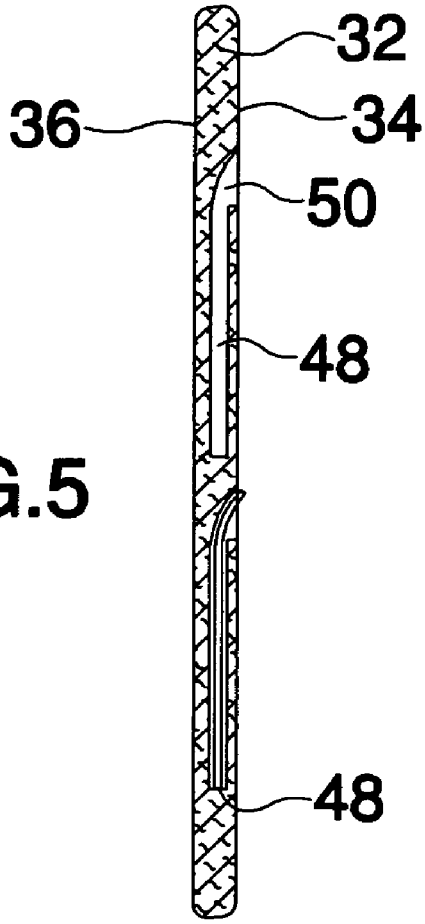
FIG. 5 is a cross-sectional view taken along line 5-5 of FIG. 4 of the present invention.
Figure 6:
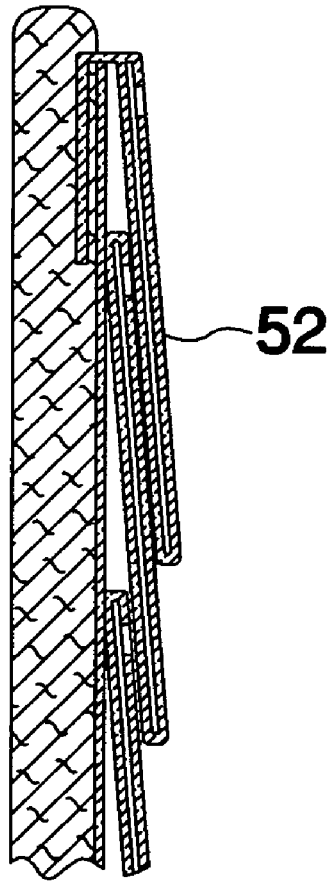
FIG. 6 is a cross-sectional view taken along line 6-6 of FIG. 4 of the present invention.
Figure 7:
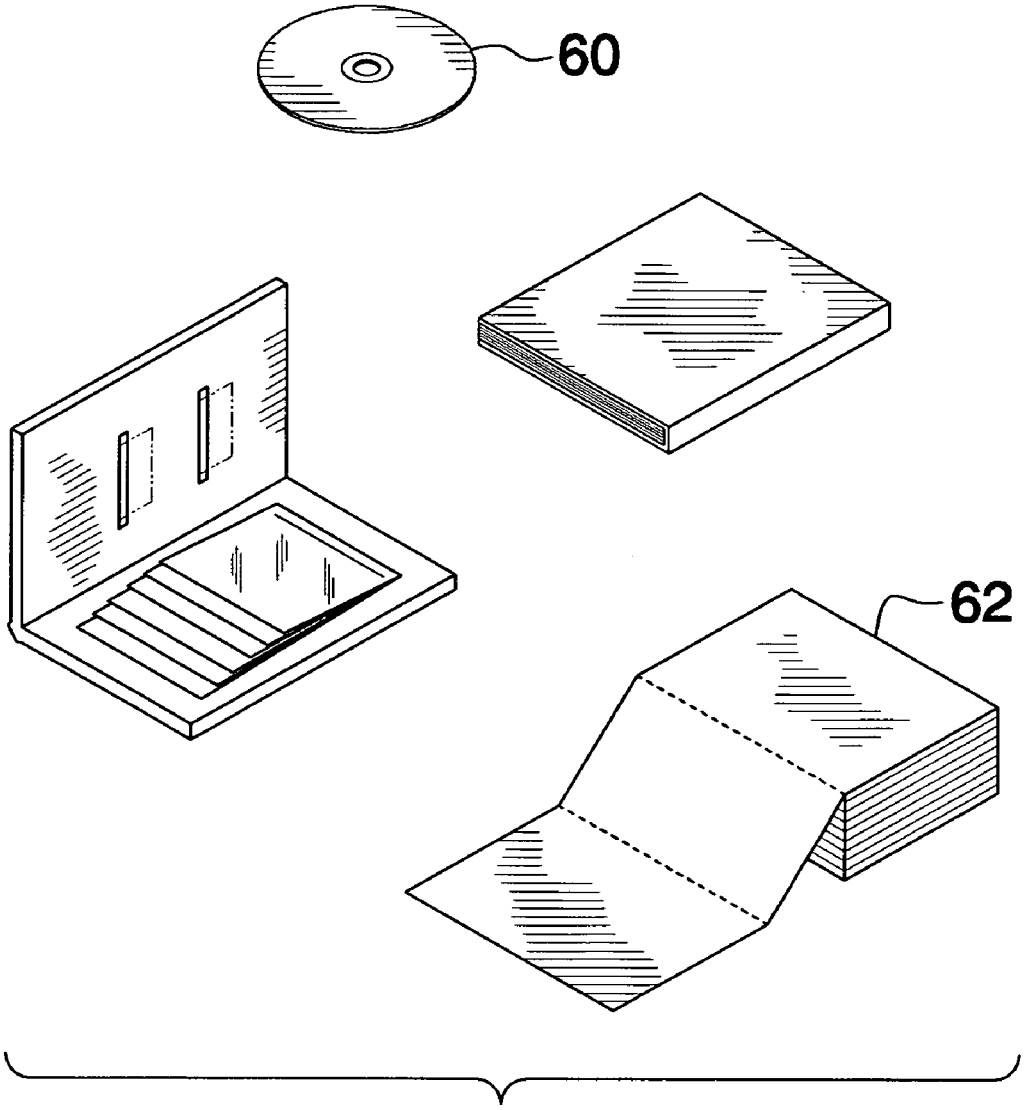
FIG. 7 is a perspective view of the present invention.

With reference now to the drawings, and in particular to FIGS. 1 through 7 thereof, a new record keeping device embodying the principles and concepts of the present invention and generally designated by the reference numeral 10 will be described.

As best illustrated in FIGS. 1 through 7, the medical record keeping system 10 generally comprises a housing 12 that has a bottom wall 14 and peripheral wall 16 that is attached to and extends upwardly from the bottom wall 14. The peripheral wall 16 includes a front wall 18, a first side wall 20, a second side wall 22 and a back wall 24. A cover 26 is hingedly coupled to an upper edge of the back wall 24. The cover 26 is selectively positionable in a closed position covering an opening into the housing 12 or an open position spaced from the opening. A securing member 28 is attached to the cover 26 for selectively securing the cover 26 in the closed position. The securing member 28 preferably includes a snap or Velcro securing member. A handle 30 is attached to a top side of the cover 26.

A panel 32 has a first side 34, a second side 36, an upper edge 38, a lower edge 40, a first lateral edge 42 and a second lateral edge 44. A fold line 46 extends from the lower edge 40 to the upper edge 38 and is positioned between the first 42 and second 44 lateral edges. A pair of cavities 48 extends into the first side 34 and then each extends downward toward the lower edge 40. Each of the cavities 46 is positioned between the first lateral edge 42 and the fold line 46. The cavities 48 each have an elongated opening 50 extending along line orientated parallel to the upper edge 38. The openings 50 of the cavities 48 are vertically spaced from each other. Each of a plurality of sleeves 52 is attached to the first side 34 of the panel 32 and each is positioned between the fold line 46 and the second lateral edge 44. The sleeves 52 each have a size adapted for receiving a compact disc. The panel 32 may be used for easily transporting required documents.

A plurality of containers 54-56 is provided. Each of the containers 54-56 has an open upper end 58. Each of the containers 54-56 is attached to an inner surface of the peripheral wall 16 so that the upper ends 58 of the containers 54-56 are directed upwardly. Two of the containers 54, 55 are positioned on the first side wall 20 and a third of the containers 56 is positioned on the front wall 18. The third of the containers 56 has a width adapted for receiving a compact disc.

Also preferably included is at least one compact disc 60 having electronic forms thereon. The forms include medical information questions, which may be tailored for specific illnesses or conditions. The forms may be in any conventional format which is readily readable by a computer. These formats may include, but are not limited to, Portable Document Format (pdf), Word, or WordPerfect. The forms may be selectively printed on cards 62 and the cards 62 then positioned in the containers 54, 55 and the cavities 48. The forms may be filled out on the computer or after they have been printed. Cards 62 are preferably provided having the correct size for being positioned in the containers or slots.

In use, a person fills out either the forms provided, or their own forms, and places them, along with any other relevant medical documents in the housing 12. They may be positioning in the containers 54-56 or in the cavities 48 as needed. Alternatively, or in additionally, the user may copy or scan all of their documents and copy that information to compact discs that can be positioned in the sleeves 52. The container 56 having size adapted for receiving a compact disc would generally be used for holding a compact disc 60 having the forms thereon. The cards 62 may be positioned in the panel 32, as needed, for easy transportation purposes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medical information storage system comprising:

a housing having a bottom wall and peripheral wall being attached to and extending upwardly from said housing, a cover being hingedly coupled to an upper edge of said peripheral wall for selectively opening or closing said bottom wall;

a panel having a first side, a second side, an upper edge, a lower edge, a first lateral edge and a second lateral edge, a fold line extending from said lower edge to said upper edge and being positioned between said first and second lateral edges, a pair of cavities extending into said first side and extending downward toward said lower edge, each of said cavities being positioned between said first lateral edge and said fold line, each of said cavities having an elongated opening extending along line orientated parallel to said upper edge, said openings of said cavities being vertically spaced from each other; and a plurality of containers, each of said containers having an open upper end, each of said containers being attached to an inner surface of said peripheral wall such that said upper ends of said containers are directed upwardly; and at least one compact disc having electronic forms thereon, said forms including medical information questions, wherein said forms may be selectively printed on cards and said cards positionable in said containers and said cavities.

2. The system according to claim 1, wherein peripheral wall includes a front wall, a first side wall, a second side wall and a back wall, said cover being hingedly coupled to an upper edge of said back wall, a securing member being attached to said cover for selectively securing said cover in said closed position, a handle being attached to a top side of said cover.

3. The system according to claim 1, further including a plurality of sleeves, each of said sleeves being attached to said panel and being positioned between said fold line and said second lateral edge, each of said sleeves having a size adapted for receiving a compact disc.

4. The system according to claim 2, wherein two of said containers are positioned on said first side wall, a third of said containers being positioned on said front wall, said third of said containers having a width adapted for receiving a compact disc.

5. A medical information storage system comprising:

a housing having a bottom wall and peripheral wall being attached to and extending upwardly from said bottom wall, said peripheral wall including a front wall, a first side wall, a second side wall and a back wall, a cover being hingedly coupled to an upper edge of said back wall, said cover being selectively positionable in a closed position covering an opening into said housing or an open position spaced from said opening, a securing member being attached to said cover for selectively securing said cover in said closed position, a handle being attached to a top side of said cover;

a panel having a first side, a second side, an upper edge, a lower edge, a first lateral edge and a second lateral edge, a fold line extending from said lower edge to said upper edge and being positioned between said first and second lateral edges, a pair of cavities extending into said first side and extending downward toward said lower edge, each of said cavities being positioned between said first lateral edge and said fold line, each of said cavities having an elongated opening extending along line orientated parallel to said upper edge, said openings of said cavities being vertically spaced from each other;

a plurality of sleeves, each of said sleeves being attached to said panel and being positioned between said fold line and said second lateral edge, each of said sleeves having a size adapted for receiving a compact disc; and a plurality of containers, each of said containers having an open upper end, each of said containers being attached to an inner surface of said peripheral wall such that said upper ends of said containers are directed upwardly, two of said containers being positioned on said first side wall, a third of said containers being positioned on said front wall, said third of said containers having a width adapted for receiving a compact disc; and at least one compact disc having electronic forms thereon, said forms including medical information questions, wherein said forms may be selectively printed on cards and said cards positionable in said containers and said cavities.

* * * * *